US005642867A

United States Patent [19]

Klestadt

[11] Patent Number: 5,642,867

[45] Date of Patent: Jul. 1, 1997

[54] AERODYNAMIC LIFTING AND CONTROL SURFACE AND CONTROL SYSTEM USING SAME

[75] Inventor: Ralph H. Klestadt, Tucson, Ariz.

[73] Assignee: Hughes Missile Systems Company, Los Angeles, Calif.

[21] Appl. No.: 471,469

[22] Filed: Jun. 6, 1995

[51] Int. Cl.[6] ..... B64C 3/38; B64C 3/56; F42B 10/16

[52] U.S. Cl. ..... 244/49; 244/3.27; 244/39; 244/46; 244/218

[58] Field of Search ..... 244/3.24, 3.27, 244/39, 45, 46, 49, 201, 218

[56] References Cited

U.S. PATENT DOCUMENTS

| | | | |
|---|---|---|---|
| 3,506,220 | 4/1970 | Sbrilli | 244/39 |
| 4,158,447 | 6/1979 | Humphries et al. | 244/3.27 |
| 5,048,773 | 9/1991 | Washington et al. . | |
| 5,211,358 | 5/1993 | Bagley | 244/3.27 |
| 5,240,203 | 8/1993 | Myers . | |
| 5,417,393 | 5/1995 | Klestadt | 244/3.27 |

FOREIGN PATENT DOCUMENTS

| | | | |
|---|---|---|---|
| 3838735 | 5/1990 | Germany . | |
| 4021633 | 2/1991 | Germany | 244/46 |
| 220097 | 6/1942 | Switzerland | 244/218 |

OTHER PUBLICATIONS

AIAA 93–0035, Washington et al. "Grid Fins–A New Concept For Missile Stability and Control" Jan. 11, 1993 p. 141.

M. Miller, "AIAA93–0035 Grid Fins –A New Concept for Missile Stability and Control –31st Aerospace Sciences Meeting & Exhibit", 11–14 Jan. 1993, Reno (USA), pp. 2–11 XP00057778.

*Primary Examiner*—Andres Kashnikow
*Assistant Examiner*—Virna Lissi Mojica
*Attorney, Agent, or Firm*—Charles D. Brown; Wanda K. Denson-Low

[57] ABSTRACT

An aerodynamic lifting and control surface comprising an external box structure that encloses an internal grid whose members are parallel to the box structure. The external box structure comprises four panels connected at their corners by spring hinges. When the hinges are unconstrained, the external box structure is compressed into a flat, thin parallelogram shape. The internal grid comprises a plurality of plates connected to each other and to the external box structure by flexible hinges. Control apparatus for use with an aerodynamic vehicle is also disclosed. The control apparatus comprises at least one aerodynamic lifting and control surface that is coupled to an actuator disposed within the vehicle and connected to the aerodynamic lifting and control surface for rotating it.

15 Claims, 5 Drawing Sheets

AERODYNAMIC LIFTING AND CONTROL SURFACE AND CONTROL SYSTEM USING SAME

BACKGROUND

The present invention relates generally to aerodynamic lifting and control surfaces and control systems, and more particularly, to a wrapped grid fin and control system for use with aerodynamic vehicles such as missiles and torpedoes that may be folded around the vehicle for storage.

Conventional grid fins are disclosed in American Institute of Aeronautics and Astronautics paper AIAA 93-0035, entitled "Grid Fins—A New Concept for Missile Stability and Control," by W. D. Washington, U.S. Army Missile Command, Redstone Arsenal, Alabama. This paper was presented at the 31st Aerospace Sciences Meeting & Exhibit. Jan. 11–14, 1993. The disadvantage of the grid fins presented in this paper is that the arrangement of the internal grid precludes parallelogram folding and the corresponding use of flexible material for grid and box sides. Thus, this conventional grid fin arrangement is precluded from folding around the body of the missile and provide for a compressed storage configuration.

Conventional grid fin designs are configured to maximize strength to weight ratio by orienting the internal grid structure at 45° to the main frae. This orientation results in a structure which can not be compressed in a radial direction, and must be stored by rotating the fin toward to the missile body in a plane defined by the deployed fin axis and the missile axis. The resulting external envelope required for the folded grid fins adds the fin chord length to the missile radius at each fin circumferential location. This additional storage volume makes the use of grid fins on airframes requiring compressed carriage unfeasible.

Accordingly, it is an objective of the present invention to provide for an aerodynamic lifting and control surface comprising a wrapped grid fin for use with an aerodynamic vehicle. It is a further objective of the present invention to provide for a aerodynamic lifting and control surface that may be folded around the body of the vehicle to provide for a compact storage arrangement. It is another objective of the present invention to provide for control system for use with aerodynamic vehicles that employs the aerodynamic lifting and control surface.

SUMMARY OF THE INVENTION

To meet the above and other objectives, the present invention provides for an aerodynamic lifting and control surface comprising an external box structure that encloses an internal grid whose members are parallel to the box structure. The external box structure comprises four panels connected at their corners by spring hinges. When the hinges are unconstrained, the external box structure is compressed into a flat, thin parallelogram shape. The internal grid comprises a plurality of plates connected to each other and to the external box structure by flexible hinges. The present invention also provides for control apparatus for use with an aerodynamic vehicle. The control apparatus comprises at least one aerodynamic lifting and control surface that is coupled to an actuator disposed within the vehicle and connected to the aerodynamic lifting and control surface for rotating it.

The present invention is a modification of a conventional grid-type aerodynamic lifting or control surface. The present wrapped grid fin is constructed so that its internal grid is parallel to the external box structure, as opposed to being offset by 45° as in the conventional grid fin. By orienting the grid structure parallel to the edges of the external box structure, the entire grid fin may be collapsed into a relatively thin assembly similar to the way in which a rectangular box may be collapsed into a narrow parallelogram. This collapsed fin is then wrapped around the cylindrical body structure of the vehicle, allowing compressed storage of the grid fins prior to use.

The wrapped grid fin is designed for use with airframes and torpedoes that require highly compressed carriage prior to launch. Grid fin type aerodynamic lifting and control surfaces have been documented to have several advantages over conventional planar lifting surfaces, including lift capability to very high angles of attack, and low aerodynamic hinge moments.

The present invention, by virtue of aligning the internal grid structure parallel to the external box structure, takes advantage of the ability of a parallelogram-shaped structure to maintain its external sides at a constant length while decreasing its effective area to zero. By fabricating the external box structure or frame and internal grid from flexible material, the compressed grid fin may be wrapped around the body of the vehicle, allowing compact storage of grid fins. The diameter of the vehicle increases by the thickness of the compressed parallelogram sides. This allows the use of the wrapped grid fins to current and future missiles, for example, that have been identified as needing high aerodynamic control authority, but which have severe packaging constraints such as are caused by tubes and launch platform interference.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 7 is an enlarged front view of a control surface of the present invention;

FIG. 8 is a side view of the control surface of FIG. 4;

DETAILED DESCRIPTION

Figure 1:
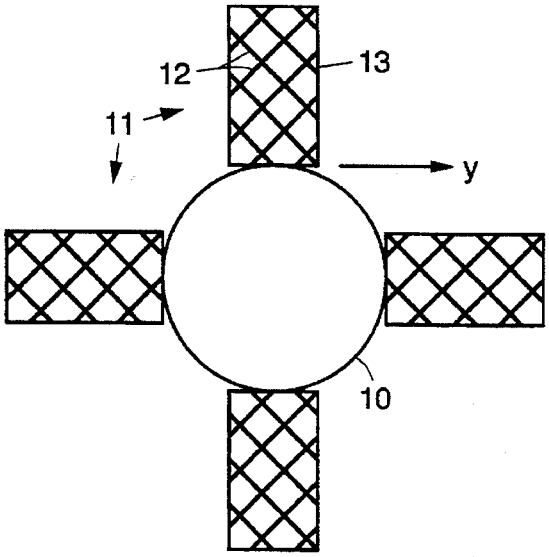
FIGS. 1–3 show cross sectional, side and perspective views, respectively, of conventional grid fins disposed on a missile.
Figure 2:
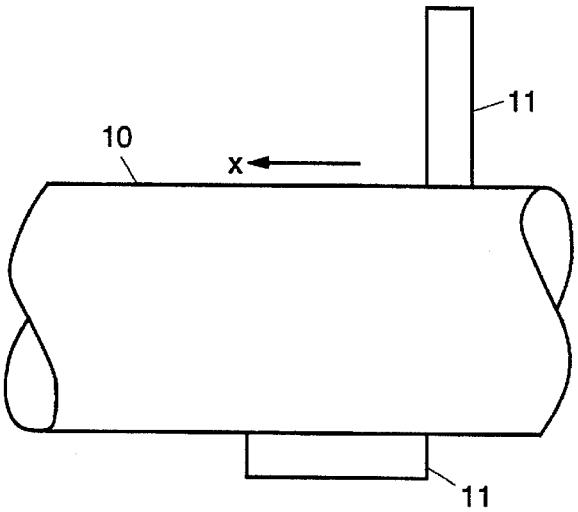
Figure 3:
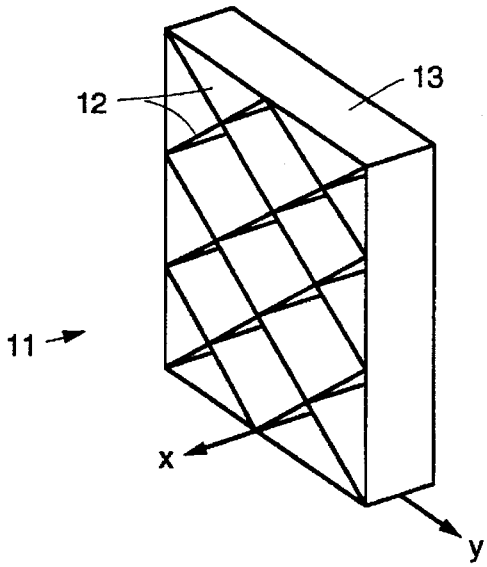

Referring to the drawing figures, FIGS. 1–3 show cross sectional, side and perspective views, respectively, of conventional grid fins 11 disposed on a vehicle 10, which may be an airframe such as a missile 10, or which may be a torpedo 10. The grid fins 11 may be used in place of conventional planar aerodynamic surfaces to provide stability and control of missiles 10 requiring high control forces with small hinge moments. FIG. 1 illustrates installation of conventional grid fins 11 in a representative four-fin (cruciform) arrangement. The fins 11 are arranged with their grid 12 aligned with the direction of missile motion (identified as the x axis in FIGS. 2 and 3). FIG. 2 illustrates the fins 11 viewed from the side, with the top fin 11 shown in a deployed position and the bottom fin 11 showed in a stowed position, folded down along the surface of the body of the missile 10. Clearly, this storage arrangement adds a significant amount of volume external to the surface of the body of the missile 10, precluding compressed carriage of the fins 11 for most installations. FIG. 3 shows the details of the grid 12 arranged at 45° relative to an external box structure 13.

Figure 4:
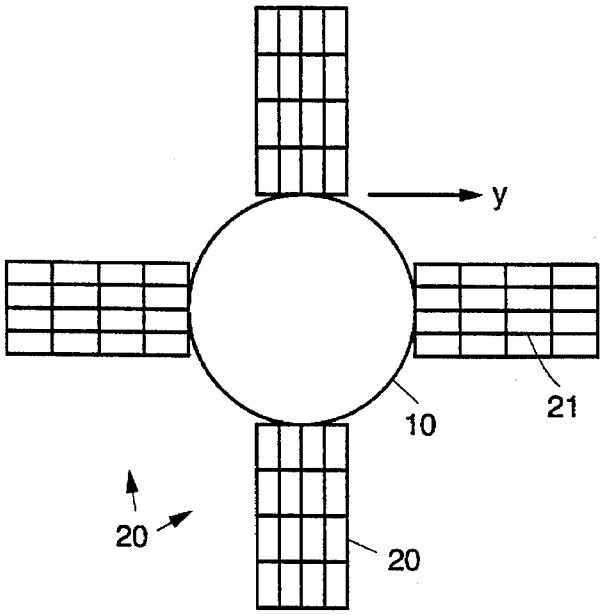
FIG. 4–6 show cross sectional, side and perspective views, respectively, of control surfaces in accordance with the present invention disposed on a missile.
Figure 5:
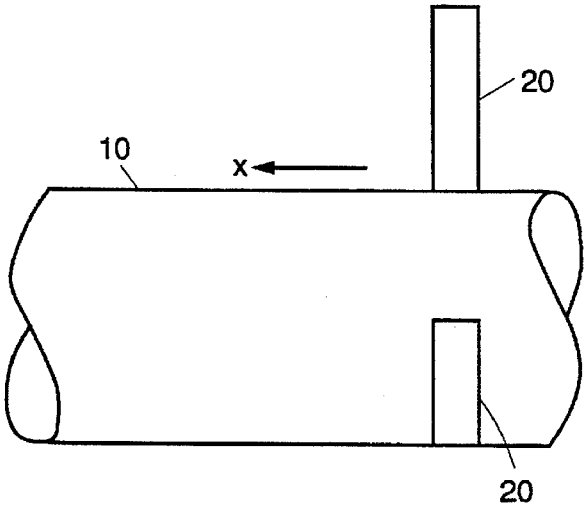
Figure 6:
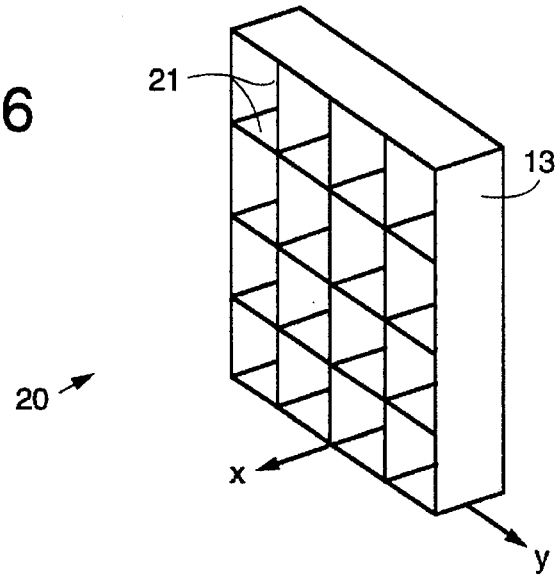

FIG. 4–6 show cross sectional, side and perspective views, respectively, of aerodynamic lifting and control surfaces 20 comprising wrapped grid fins 20 in accordance with the present invention disposed on the missile 10. The present wrapped grid fins 20 have internal grids 21 arranged parallel to the external box structure 13. Reorientation of the grid 21 parallel to the external box structure 13, as illustrated in FIG, 4, allows the box structure 13 and grids 21 to be folded down as shown in FIG, 5 for the bottom fin 20. The aerodynamic effectiveness is maintained through the internal grid structure 21. Small aerodynamic hinge moments are maintained by an extremely short root chord identical to that of the conventional grid fin.

Figure 9A:
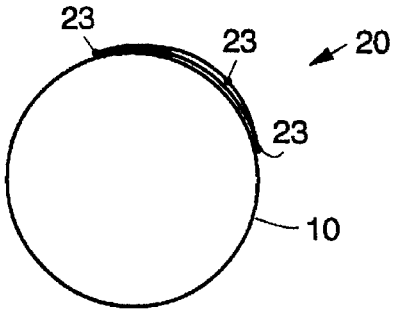
FIGS. 9*a*–9*d* show a deployment sequence for deploying the control surface.

FIGS. 7 and 8 an enlarged front and side views of the aerodynamic lifting and control surface 20 or wrapped grid fin 20 of the present invention. FIGS. 9*a*–9*d* illustrates the deployment (storage and opening) sequence for a single wrapped grid fin 20. The basic external box structure 13 is comprised of four panels 22 connected at their corners by spring hinges 23. The external panels 22 are generally made of a flexible material, such as composite material or steel, for example, whose bending characteristics may be appropriately tailored. When the spring hinges 23 are unconstrained, the external box structure 13 may be compressed into a flat, thin parallelogram, and then wrapped around the fuselage of the missile 10 in a circumferential orientation as shown in FIG. 9*a*. The internal grid 21 is comprised of plates 25 connected to each other and the external box structure 13 by flexible hinges 26, which may be made of an elastomeric material and that are able to flex through a 90° range.

Figure 9B:
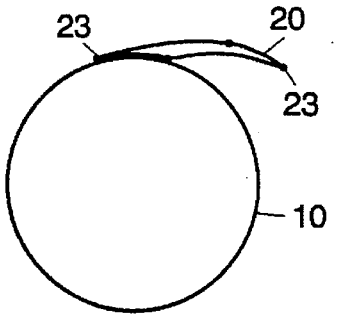
Figure 9C:
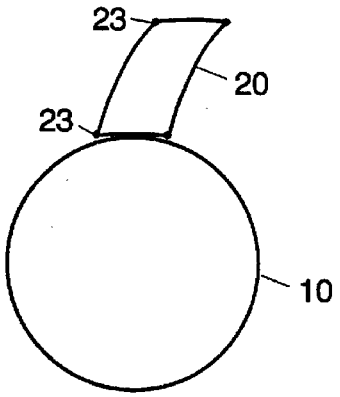
Figure 9D:
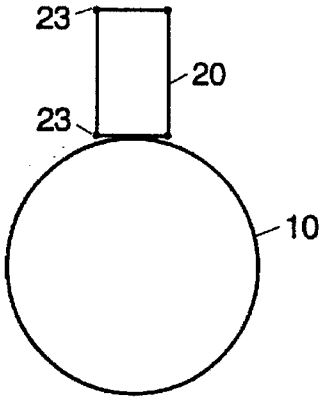
Figure 9A:
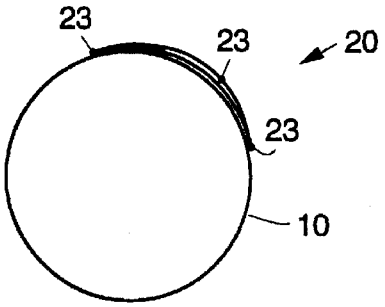
Figure 9B:
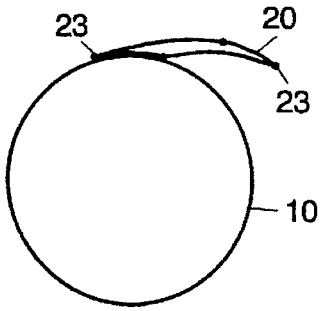
Figure 9C:
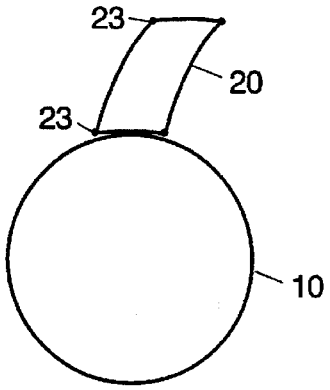
Figure 9D:
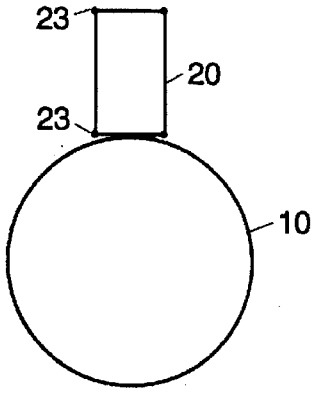

The spring hinges 23 that form the comers of the external box structure 13 contain an activation device 27 such as a spring, for example, which if unconstrained, erect the fin 20 into a rigid, box-shaped structure shown in FIG. 7. During storage the spring hinges 23 may be retained by a holding device, such an external circumferential strap (not shown), for example, that is wrapped completely around the body of the missile 10 and which is released upon command. FIGS. 9*b* and 9*c* illustrate the wrapped grid fin 20 in transition from a wrapped state to a deployed state, during which time the spring hinges 23 act to erect the box structure 13.

Upon reaching the fully deployed position, the spring hinges 23 are prevented from further motion through use of an internal locking mechanism (not shown). Once all four spring hinges 23 are locked, the grid fin 20 exists as a rigid box structure, with sufficient strength to sustain the required aerodynamic and inertial loads. Rotation of the grid fin 20 is provided through an actuator shaft 24, which is connected to an actuator 28 internal to the fuselage of the missile 10.

The aerodynamic lifting and control surfaces 20 of the present invention may be employed with canard-controlled airframes 10. These canard-controlled airframes 10 require large control forces at high angles of attack. Their control systems utilize single actuators 28 whose size is determined by the aerodynamic hinges moment of the control surfaces. The present control surfaces 20 or grid fin 20 comprise canards that provide control authority to achieve higher maneuverability than a conventional aerodynamic fin 11 with lower hinge moments and smaller actuators 28 and cost.

The aerodynamic lifting and control surfaces 20 or wrapped grid fin 20 of the present invention may be employed with a tactical ballistic missile. The very high dynamic pressure environment for this missile 10 requires large control forces. However, the volume allocated for actuators 28 internal to the body of the missile 10 is small. Use of the present grid fins 20 meets these objectives while minimizing the impact on external aerodynamics during early stages of flight.

The aerodynamic lifting and control surfaces 20 or wrapped grid fin 20 of the present invention may also be employed with a torpedo 10. The torpedo 10 may be modified in order to decrease its speed (and thus decrease its acoustic signature) while maintaining existing maneuverability and control levels. These conflicting requirements drive the need for increased hydrodynamic control authority. Since the torpedo 10 is tube launched, conventional planar control surfaces cannot be enlarged. Utilizing the present wrapped grid fins 20 provides for increased control authority with no external volume or control hinge moment impact.

Figure 10A:
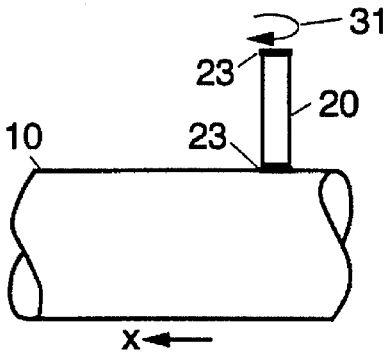
FIGS. 10*a*–10*d* show a second embodiment of the present invention.
Figure 10B:
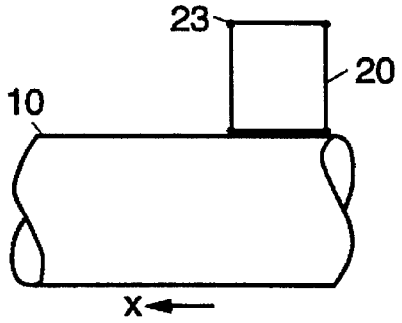
Figure 10C:
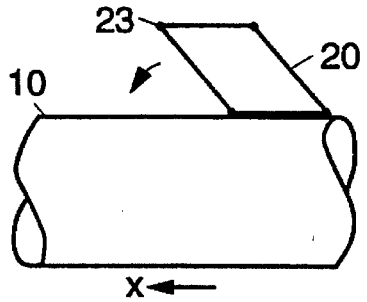
Figure 10D:
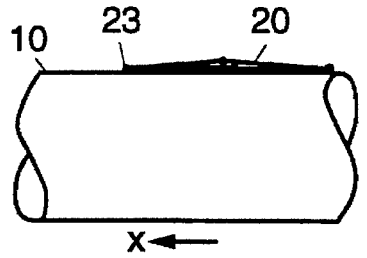

FIGS. 10*a*–10*d* show a second embodiment of aerodynamic lifting and control surfaces 20 in accordance with the present invention, and in particular show a sequence showing closing of one of the control surfaces 20. In this second embodiment, and with reference to FIGS. 7 and 8, the control surfaces 20 are rotated using the actuator 28 so that the "plane" of the box structure 13 is parallel to the axis of the missile 10 or torpedo 10, as illustrated by the arrow 31. As a result, the control surface 20 is rotated 90° relative to the orientation shown in FIGS. 7 and 8. In this orientation, the aerodynamic lifting and control surfaces 20 is folded into a parallelogram shape that lies along the axis of the missile 10 or torpedo 10 as shown in FIGS. 10*b*–10*d*. Thus, it this embodiment, the panels 22 and the internal grid 21 need not be flexible, since they are not required to wrap around the body of the missile 10 or torpedo 10

Thus, there has been disclosed an aerodynamic lifting and control surface for use with aerodynamic vehicles such as missiles and torpedoes, and the like, that may be folded around the body of the vehicle to provide for compact storage. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. An aerodynamic lifting and control surface comprising:

a plurality of four outer panels arranged end-to-end to form an external box-shaped structure, with the outer panels joined one to another by separate spring hinge assemblies;

an internal grid structure located within the external box-shaped structure and comprising a plurality of separate grid plates connected to each other and further connected at opposite ends to separate outer panels, with each of said grid plates extending substantially parallel to one of the outer panels when the spring hinge assemblies are unconstrained, whereby the external box-shaped structure may be compressed into a thin parallelogram shape when the spring hinge assemblies are constrained.

2. The aerodynamic lifting and control surface of claim 1 wherein the outer panels comprise flexible material.

3. The aerodynamic lifting and control surface of claim 2 wherein the flexible material comprises composite material.

4. The aerodynamic lifting and control surface of claim 2 wherein the flexible material comprises steel.

5. The aerodynamic lifting and control surface of claim 1 wherein the plurality of said plates comprise flexible material.

6. A control apparatus for use with an aerodynamic vehicle, said apparatus comprising:

an aerodynamic lifting and control surface comprising:

a plurality of four outer panels arranged end-to-end to form an external box-shaped structure, with the outer panels joined one to another by separate spring hinge assemblies;

an internal grid structure located within the external box-shaped structure and comprising a plurality of separate grid plates connected to each other and further connected at opposite ends to separate outer panels, with each of said grid plates extending substantially parallel to one of the outer panels when the spring hinge assemblies are unconstrained, an actuator disposed within the vehicle and connected to the aerodynamic lifting and control surface for rotating the control surface, and the external box-shaped structure being compressible into a thin parallelogram shape when the spring hinge assemblies are constrained.

7. The apparatus of claim 6 wherein the outer panels comprise flexible material.

8. The apparatus of claim 6 wherein the flexible material comprises composite material.

9. The apparatus of claim 8 wherein the flexible material comprises composite material.

10. The apparatus of claim 8 wherein the flexible material comprises steel.

11. The apparatus of claim 6 wherein the plurality of grid plates comprise flexible material.

12. The apparatus of claim 6 wherein the flexible hinges comprise elastomeric material.

13. The apparatus of claim 6 wherein the flexible hinges flex through a 90° range.

14. The apparatus of claim 6 wherein the external box structure and the internal grid are oriented orthogonal to an axis of the vehicle and are compressed into a thin parallelogram shape that extends along the axis of the vehicle.

15. The apparatus of claim 6, wherein the thin parallelogram shape extends about a circumferential portion of the vehicle.

* * * * *